US009924764B2

(12) United States Patent
Cazarez

(10) Patent No.: US 9,924,764 B2
(45) Date of Patent: Mar. 27, 2018

(54) DISPOSABLE INSERT FOR FOOTWEAR

(71) Applicant: Rachele Cazarez, Emeryville, CA (US)

(72) Inventor: Rachele Cazarez, Emeryville, CA (US)

( * ) Notice: Subject to any disclaimer, the term of this patent is extended or adjusted under 35 U.S.C. 154(b) by 0 days.

(21) Appl. No.: 14/796,991

(22) Filed: Jul. 10, 2015

(65) Prior Publication Data

US 2016/0015128 A1 Jan. 21, 2016

Related U.S. Application Data

(60) Provisional application No. 62/023,282, filed on Jul. 11, 2014.

(51) Int. Cl.

| | |
|---|---|
| ***A43B 13/38*** | (2006.01) |
| ***A43B 17/00*** | (2006.01) |
| ***A43B 17/18*** | (2006.01) |
| ***A43B 17/14*** | (2006.01) |
| ***A43B 1/00*** | (2006.01) |
| ***A43B 17/10*** | (2006.01) |

(52) U.S. Cl.

CPC ..... *A43B 17/003* (2013.01); *A43B 1/0081* (2013.01); *A43B 17/105* (2013.01); *A43B 17/14* (2013.01); *A43B 17/18* (2013.01)

(58) Field of Classification Search

CPC ..... A43B 17/105; A43B 17/18; A43B 17/14; A43B 17/102

USPC ..... 36/43, 44

See application file for complete search history.

(56) References Cited

U.S. PATENT DOCUMENTS 4,864,740 A * 9/1989 Oakley ..... A43B 17/105 12/142 N
2002/0066209 A1* 6/2002 Steed ..... A43B 13/24 36/44
2002/0092199 A1* 7/2002 Fish ..... A43B 13/02 36/3 B
2005/0233662 A1* 10/2005 Kimbrell ..... B32B 27/12 442/149
2009/0313852 A1* 12/2009 Davenport ..... A43B 1/0045 36/44
2015/0082660 A1* 3/2015 Ofray, Sr. ..... A43B 17/10 36/11.5

OTHER PUBLICATIONS

Website—http://www.amazon.com/Summer-Soles-Ultra-Absorbent-Insoles/dp/B002C3B82M/ref=sr_1_3?ie=UTF8&qid=1427725589&sr=8-3&keywords=summer+soles (obtained on or about Aug. 2015).

(Continued)

*Primary Examiner* — Ted Kavanaugh
(74) *Attorney, Agent, or Firm* — LaRiviere, Grubman PC

(57) ABSTRACT

A disposable insert for footwear comprised of a top surface and a bottom surface. The top and bottom surfaces are substantially thin and made of PP spunbonded nonwoven materials to keep a wearer's foot clean by absorbing sweat, odor and dirt. The top surface has a high coefficient of friction to provide good traction to the bottom of the wearer's foot during wear, especially for those individuals whose feet tend to sweat often while wearing shoes. The bottom surface has an anti-slip adhesive coating for allowing the insert to adequately grip the insole of a shoe without leaving a residue that could damage the wearer's shoe when removed, yet easily moveable in shoes as necessary. The present invention also provides a disposable insert composed of different colors and patterns to satisfy the fashionable preferences of the wearers.

4 Claims, 10 Drawing Sheets

(56) References Cited

OTHER PUBLICATIONS

Website—http://www.summersoles.com/shop-womens.html (obtained on or about Aug. 2015).
Website—http://www.amazon.com/Summer-Soles-Softness-Stay-Dry-Insoles/dp/B003E4983E (obtained on or about Aug. 2015).

* cited by examiner

DISPOSABLE INSERT FOR FOOTWEAR

PRIORITY CLAIM

This non-provisional application claims priority to Provisional Patent Application Ser. No. 62/023,282, entitled "A Disposable insert for Footwear", filed on Jul. 11, 2014.

TECHNICAL FIELD

The present invention relates generally to footwear and, more specifically without limitation, to a disposable hygienic shoe insole insert that adheres to the inside sole of a shoe for keeping a user's foot clean by absorbing sweat, odor and dirt, and for preventing the user's foot from slipping within their shoe.

BACKGROUND OF THE INVENTION

Over the years, there have been many types and sizes of shoe inserts introduced to the marketplace, some of which are intended to last the lifetime of the shoe and others which are intended to be replaced after extended use. Those insoles which are intended to last the lifetime of the shoe, or for an extended period of time, such as four to six weeks before replacing, are generally made of foams or plastics filled with air or liquid. During the intended lifetime of these types of insoles, they tend to deteriorate and lose some of their properties, such as an intended cushion effect or odor control. Also, since they are exposed over a relatively long period of time to the moisture and odor of the foot, the shoe in which they are used can tend to retain the wetness and odor.

Many of the insoles made of latex foam are washable and contain odor neutralizers such as baking soda and/or activated charcoal. Unfortunately, the deodorant efficacy and effectiveness of the baking soda and/or activated charcoal are significantly diminished during the washing cycle. In addition, the presence of latex foam will promote foot irritation and discomfort to consumers who are more sensitive and allergic to natural latex. This phenomenon is even further worsened when the foot is enclosed within a warm, dark, moist and restricted air-circulation environment such as the shoe.

What is lacking and needed in the art is a disposable and simple construction shoe insert that is intended for shorter use and provides an effective means of reducing odor, absorbing moisture, minimizing bacterial growth as a result and providing traction to the bottom of a wearer's foot especially during moisture-causing conditions. The encouragement to promote more frequent exchange of shoe inserts will enhance foot hygiene, especially for those who do not wear socks or stockings. The top surface of the insert should have a "high coefficient of friction" and be made of PP Spunbonded nonwoven material, which will provide better traction to the bottom of the foot during wear; particularly for those individuals who have feet that tend to sweat often and/or those living in humid conditions that cause issues in all style of shoes. The bottom of the insert should have an anti-slip coating that allows the insert to adequately grip the inside of the shoe, without leaving adhesive residue or damaging the inner sole of the wearer's shoe.

The adhesive used for gripping and/or adhering to the inside sole of a shoe should be able to provide good temporary adhesion especially for open shoes, such as men's and women's sandals, women's dress heels and slides, that do not have walls to maintain the position of cushioning insoles or supportive devices. There have been attempts to provide shoe inserts for open shoes. However, most of these shoe inserts are usually unfashionable since they are made of only one color and typically do not match the shoe in which they are being used. Likewise, shoe inserts normally include an inadequate means for properly securing themselves to remain in place while used in an open shoe, and therefore, the shoe insert could likely fall out of place when not weighted down by a wearer's foot.

The combination of the "high coefficient of friction" for the top surface and the anti-slip bottom surface ensures that the insert stays securely in place inside the shoe during use. The insert should also be designed to have just one shape "uni-foot" to fit, meaning it mirrors both the right and left foot in each of the various sizes, in order to be more convenient and easier to use. The custom sizing of the insert allows for proper insertion into shoes since no cutting is required. Hence, proper traction (top & bottom) is even more important in this "uni-foot" insert design.

In light of the shortcomings in the prior art, there is a need for an improved shoe insert that adheres to the inside sole of a wearer's shoe even if it is an open-shoe or open-toe design. Likewise, there is a need for an improved shoe insert that is disposable and will keep a wearer's foot clean by absorbing sweat, odor and dirt. Further, there is a need for an improved shoe insert that includes a top surface for providing traction to the bottom of a wearer's foot especially during moisture-causing conditions and a bottom surface having an adhesive layer for ensuring the insert will stay securely in place inside the shoe during use, yet removes cleanly from the insole of the shoe at the end of use.

BRIEF SUMMARY OF THE INVENTION

The present invention pertains to a substantially thin disposable shoe insert for footwear that is economical and simple in construction that is intended for shorter use and for providing an effective means of reducing odor, absorbing moisture, minimizing bacterial growth as a result, and for providing better traction to the bottom of a wearer's foot especially when used in an environment that promotes sweat, dampness, or humidness.

Another aspect of the present invention is to encourage more frequent exchange of shoe inserts by individuals for enhancing foot hygiene, especially for those who do not wear socks or stockings.

An additional aspect of the present invention is to provide a disposable insert for footwear that provides better traction to the bottom of a wearer's foot during wear, particularly for those individuals who wear high heels, platform style shoes, stylish/dressy high-heel styled shoes, sandals and/or for those individuals whose feet tend to sweat often and/or live in a humid environment.

A further aspect of the present invention is to provide a disposable insert having a bottom that includes an anti-slip coating for allowing the insert to adequately grip the inside and/or insole of a shoe for removing cleanly without leaving an adhesive residue that could damage the inner sole of the wearer's shoe.

An even further aspect of the present invention is to provide a disposable insert that helps to prolong the life of a shoe by avoiding direct wear-and-tear on the sole of the shoe when the insert is used as directed.

In one embodiment of the invention, the disposable insert will be comprised of a substantially thin top and bottom surface, wherein the top and the bottom surfaces are made of PP spunbonded nonwoven material or the like for keeping a wearer's foot clean by absorbing sweat, odor and dirt; the top surface having a high coefficient of friction for providing good traction to the bottom of the wearer's foot during wear; and the bottom surface having an anti-slip adhesive coating for allowing the insert to adequately grip the insole of a shoe and to remove cleanly from the insole of the shoe.

The present invention also provides a disposable insert comprised of PP spunbonded material or the like that is composed of different colors for matching a wearer's shoe in order to provide an aesthetically pleasing and/or fashionable insert.

The present invention further provides a disposable insert composed of PP spunbonded material or the like composed of bright colors and different patterns in order to satisfy and/or meet the particular fashionable preferences and/or style needs of the wearer.

The present invention additionally provides a disposable insert that includes better temporary adhesion for gripping and/or adhering to the inside sole of a shoe, especially for open shoes, such as men's and women's sandals, women's dress heels and slides, that do not have walls for maintaining the position of the insert device.

The present invention also provides a new disposable insert that is easily and efficiently manufactured and marketed.

It is an additional feature of the present invention to provide an insert that allows for better comfort to the wearer due to the security of the wearer's foot in the shoe.

It is a further feature of the present invention to provide a new disposable insert that includes an adequate amount of coefficient of friction on the top surface of the insert in order to prevent foot slippage of individuals who wear heeled style shoes, specifically high-heels. Equally, the insert prevents foot slippage for users who wear sport shoes, non-walled shoes and open shoes.

It is even a further feature of the present invention to provide a new disposable insert for open-toe shoes, including high-heels that are open-toe.

Another feature of the present invention is to provide a shoe insert that maintains the integrity of the wearer's shoe size due to the thinness of the shoe insert, by not adding any unnecessary bulkiness that takes away space for the foot to fit in the shoe comfortably.

A further feature of the present invention is to provide a shoe insert that is easily repositioned while being inserted into a shoe, stays in place all day, yet is easily removable when used properly by a user.

Accordingly, for a better understanding of the invention, its functional advantages and the specific objects attained by its uses, reference should be made to the accompanying drawings, claims and descriptive matter in which there are illustrated embodiments of the current invention.

DETAILED DESCRIPTION OF THE INVENTION

The following detailed description is of the best currently contemplated modes of carrying out various embodiments of the invention. The description is not to be taken in a limiting sense, but is made merely for the purpose of illustrating the general principles of the invention, since the scope of the invention is best defined by the appended claims.

Figure 1:
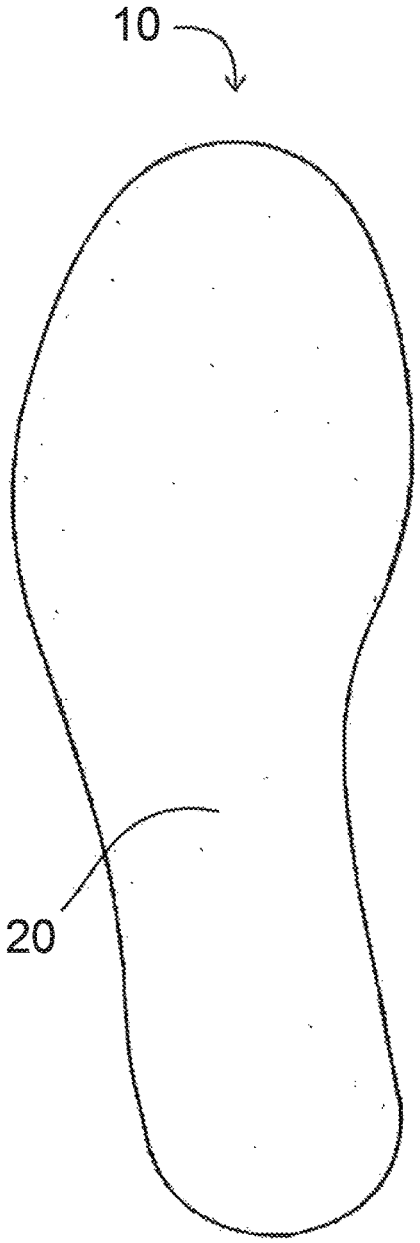
FIG. 1 is a top view of the top surface of the disposable insert or footwear.
Figure 2:
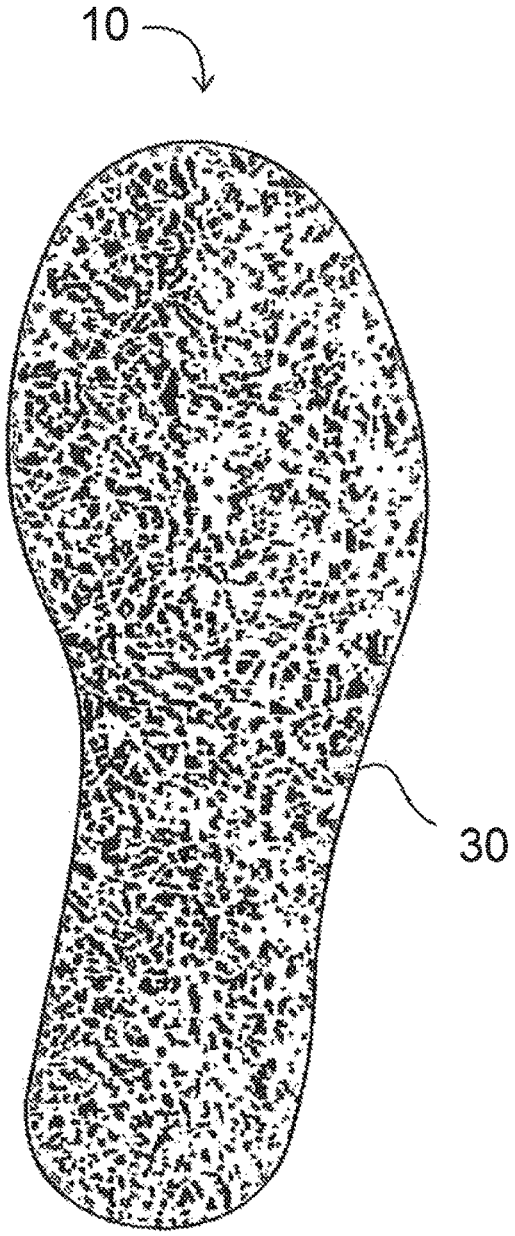
FIG. 2 is a top view of the bottom surface of the disposable insert for footwear.

Referring now to the drawings, FIGS. 1 and 2 refer to a disposable insert 10 for footwear. The disposable insert 10 is comprised of a top surface 20 and a bottom surface 30. The insert 10 is made of PP spunbonded nonwoven material or the like that helps to keep a user's foot clean by absorbing sweat, odor and dirt. Moreover, the PP spunbonded nonwoven material or the like is comprised of different colors and patterns for providing an insert 10 that meets the particular fashionable preference and/or style needs of the wearer.

Figure 3:
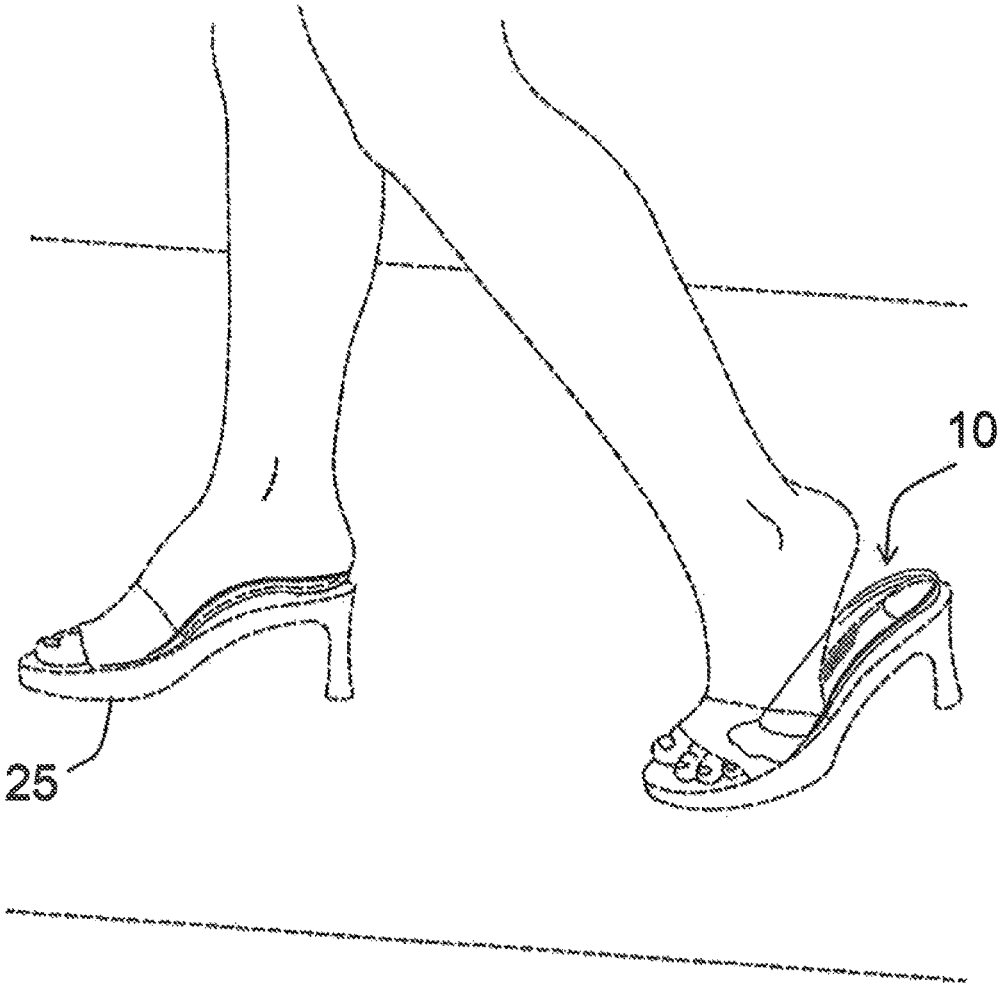
FIG. 3 is a front perspective view illustrating a wearer using the disposable insert on a pair of high-heeled shoes that are open-toe. The shoe depicted in FIG. 3 is for illustrative purposes only and does not constitute or form any part of the claimed invention.

Referring still to FIGS. 1 and 2, the insert 10 also includes a top surface 20 that has a high coefficient of friction for providing good traction to the bottom of the wearer's foot during wear. Further, the PP spunbonded nonwoven material is comprised of a dot (diamond) design, a cross (cambrella) design, or a sesamoid design or a combination. These particular designs are very helpful to users who wear high heel type shoes, platform-style shoes, or stylish/dressy high-heels since the position of a user's foot is in a compromised position as depicted in FIG. 3. Likewise, these types of designs are helpful to a user since they provide better traction and prevent slippage to the bottom of the user's foot while wearing high heel type shoes, platform-style shoes, or stylish/dressy high-heels especially during damp and/or humid conditions.

Referring even further to FIGS. 1 and 2, the insert 10 additionally includes a bottom surface 30 which includes anti-slip adhesive coating 31 (not separately shown) that allows the insert 10 to adequately grip the insole of the user's shoe without damaging it.

In one embodiment of the invention, the anti-slip adhesive coating 31 has a tack strength of 0.1 Lbf/in to 2.4 Lbf/in. The tack strength is a measure of the initial attraction or the grab strength of the adhesive to the insole of the user's shoe. The range of the aforementioned tack strength allows the insert 10 to adequately grip the insole of the user's shoe without slipping.

In another embodiment of the invention, the anti-slip adhesive coating 31 has a peel adhesion strength of 0.1 Lbf/in to 2.0 Lbf/in. The peel adhesion strength is a measure of the bond strength between the adhesive coating 31 and the insole of the user's shoe. The range of the aforementioned peel adhesion strength allows the insert 10 to be removed cleanly from the user's insole without leaving a residue.

An alternative embodiment of the invention uses a T1055+ type adhesive comprised of a proprietary water based adhesive developed to provide better temporary adhesion to a variety of substrates. This adhesive is slightly more aggressive than standard T1055.

Referring to FIG. 3, a user or wearer can use the disposable insert 10 with high heel style shoes 25, platform-style shoes 25 or stylish/dressy high-heel shoes 25.

Figure 4:
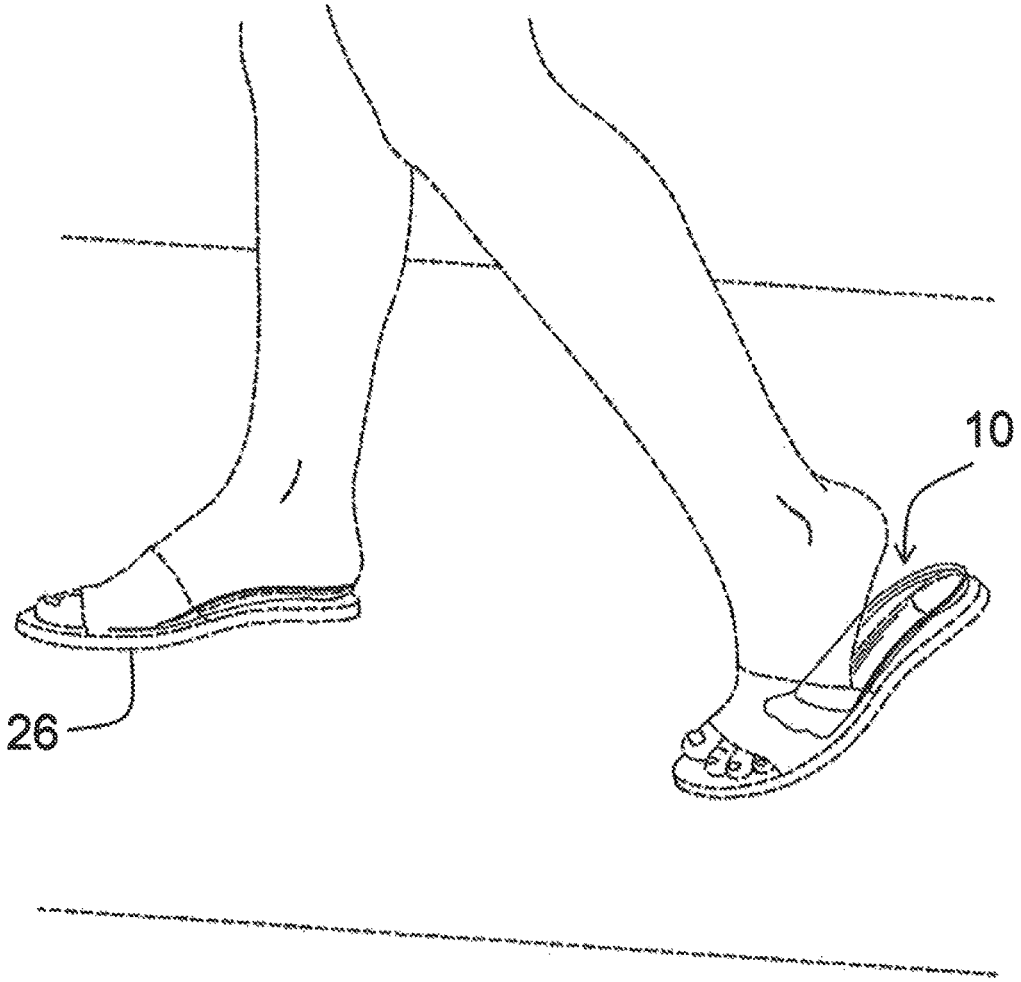
FIG. 4 is a front perspective view illustrating a wearer using the disposable insert on a pair of open-toe shoes or a sandal-type shoe. The shoe depicted in FIG. 4 is for illustrative purposes only and does not constitute or form any part of the claimed invention.

Referring to FIG. 4, a user or wearer can use the disposable insert 10 with a pair of open-toe shoes 26 or a pair of sandal type shoes 26.

Figure 5:
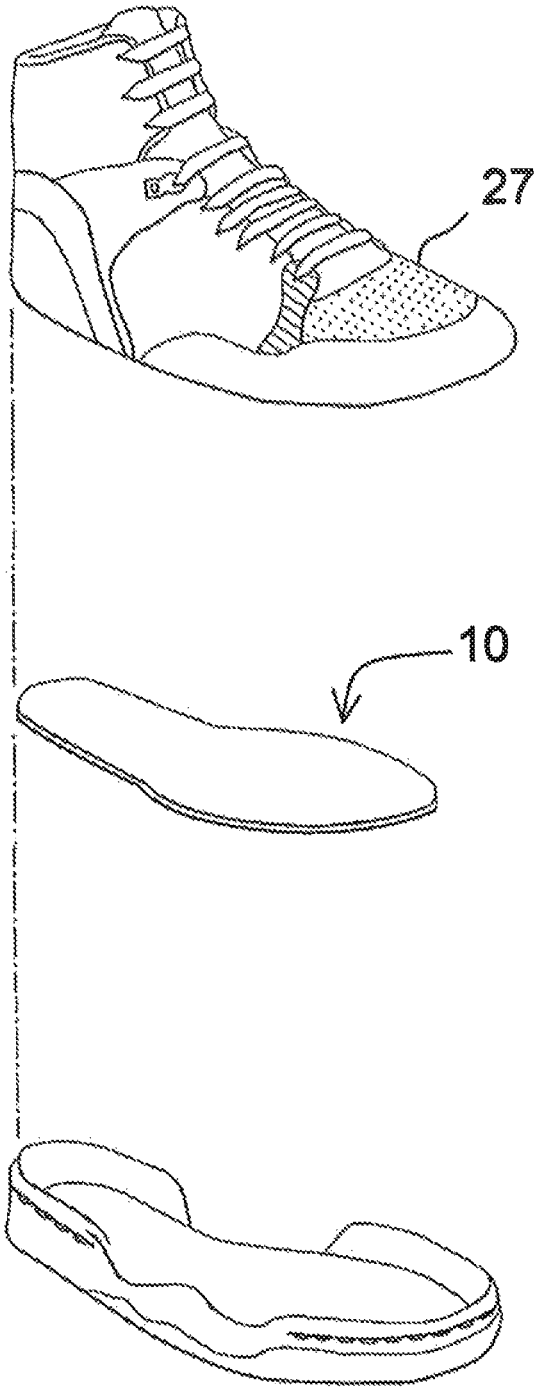
FIG. 5 is a front perspective view illustrating one embodiment of the invention where the disposable insert can be used in regular, closed-toe shoes. The shoe depicted in FIG. 5 is for illustrative purposes only and does not constitute or form any part of the claimed invention.

Referring to FIG. 5, a user or wearer can use the disposable insert 10 with regular, closed-toe shoes 27.

Figure 6:
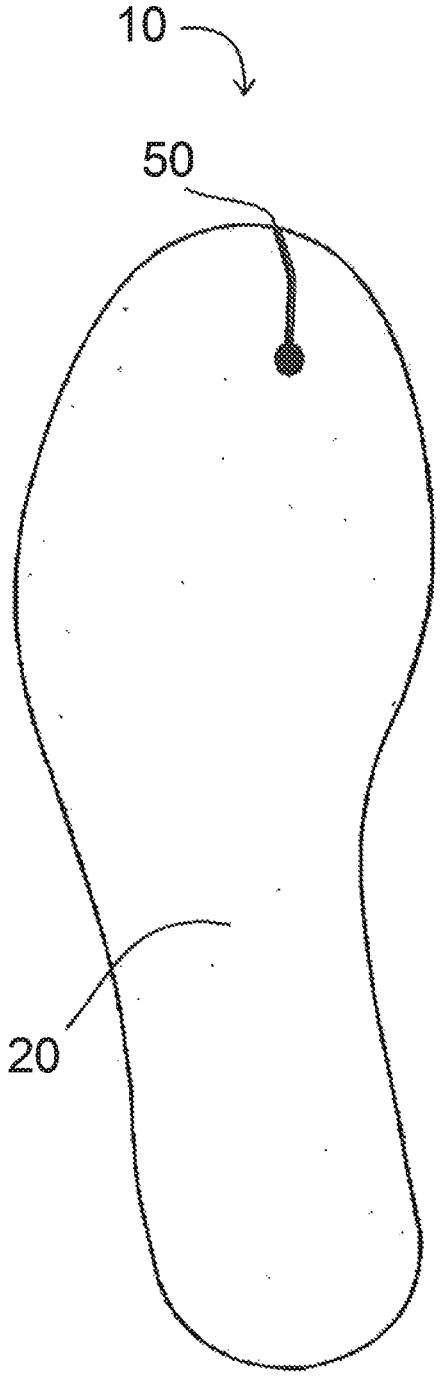
FIG. 6 is a top view of the top surface of the disposable insert for footwear showing an alternative embodiment having a front slit.
Figure 7:
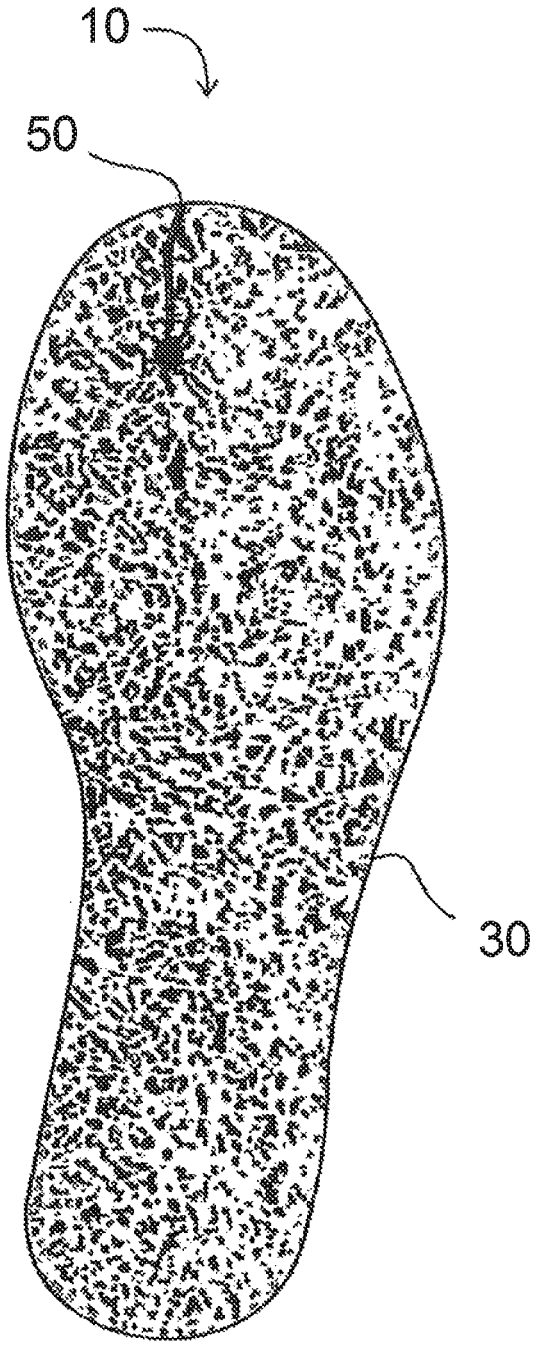
FIG. 7 is a top view of the bottom surface of the disposable insert for footwear showing an alternative embodiment having a front slit.
Figure 10:
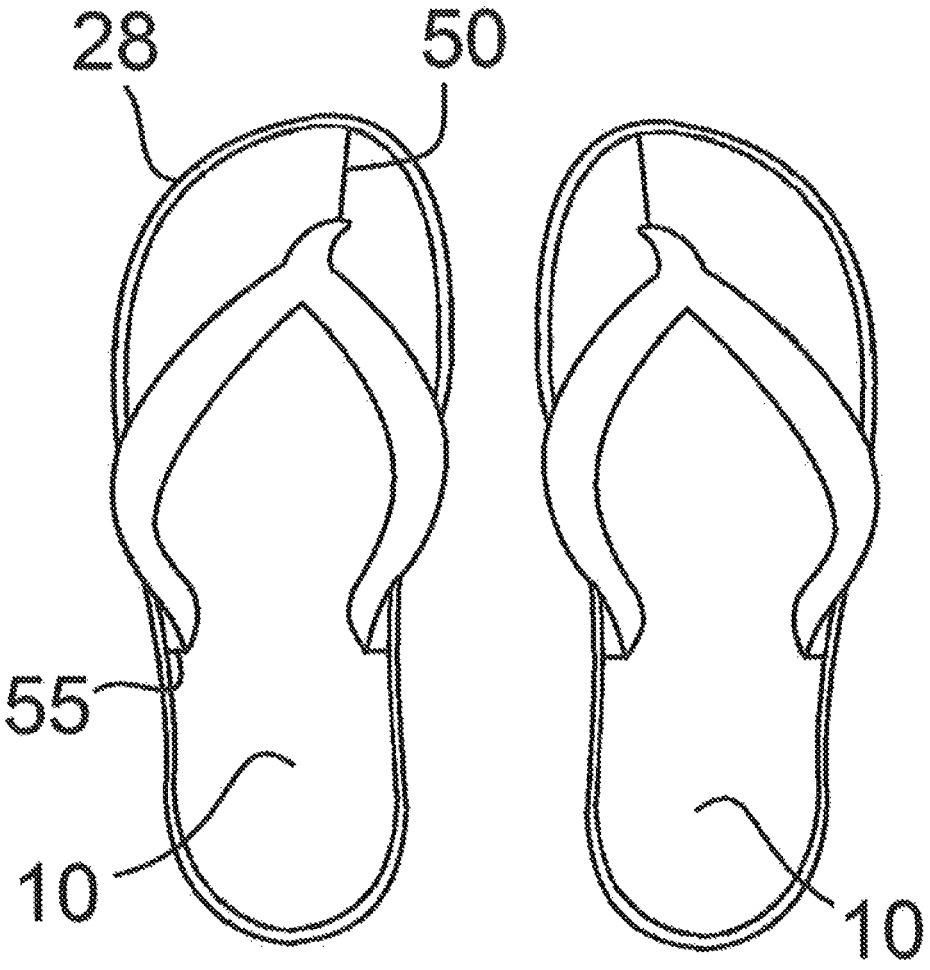
FIG. 10 is a front view illustrating the disposable insert being used on a pair of flip-flop like shoes. The shoe depicted in FIG. 10 is for illustrative purposes only and does not constitute or form any part of the claimed invention.

Referring to FIGS. 6 and 7, an alternative embodiment of the invention includes a front slit 50 for use with flip-flop 28 like shoes as depicted in FIG. 10.

Figure 8:
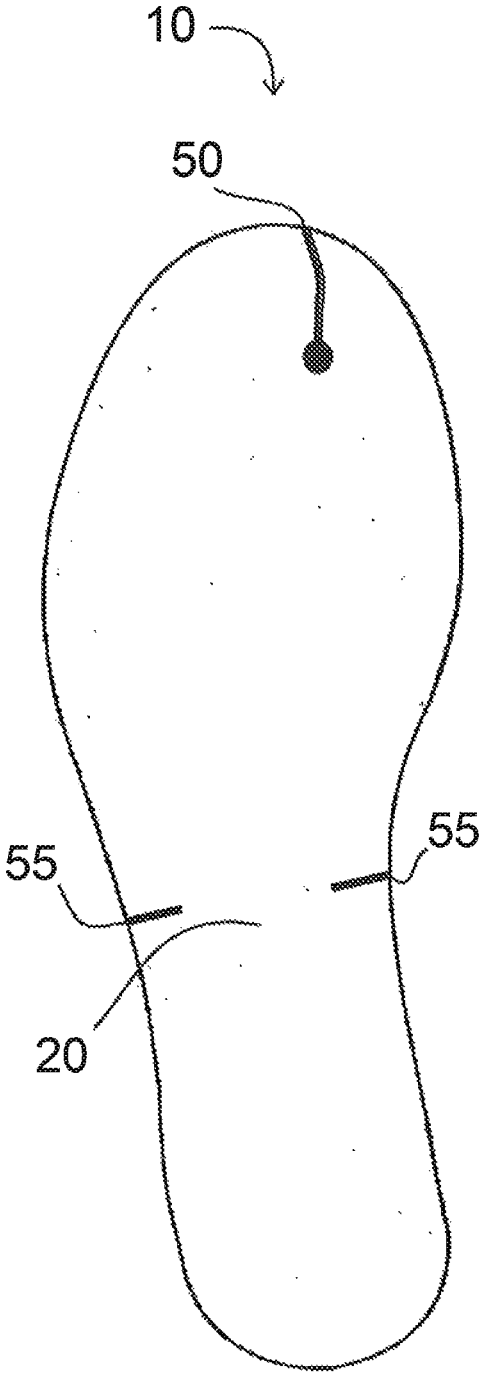
FIG. 8 is a top view of the top surface of the disposable insert for footwear showing an alternative embodiment having a front slit and a side slit.
Figure 9:
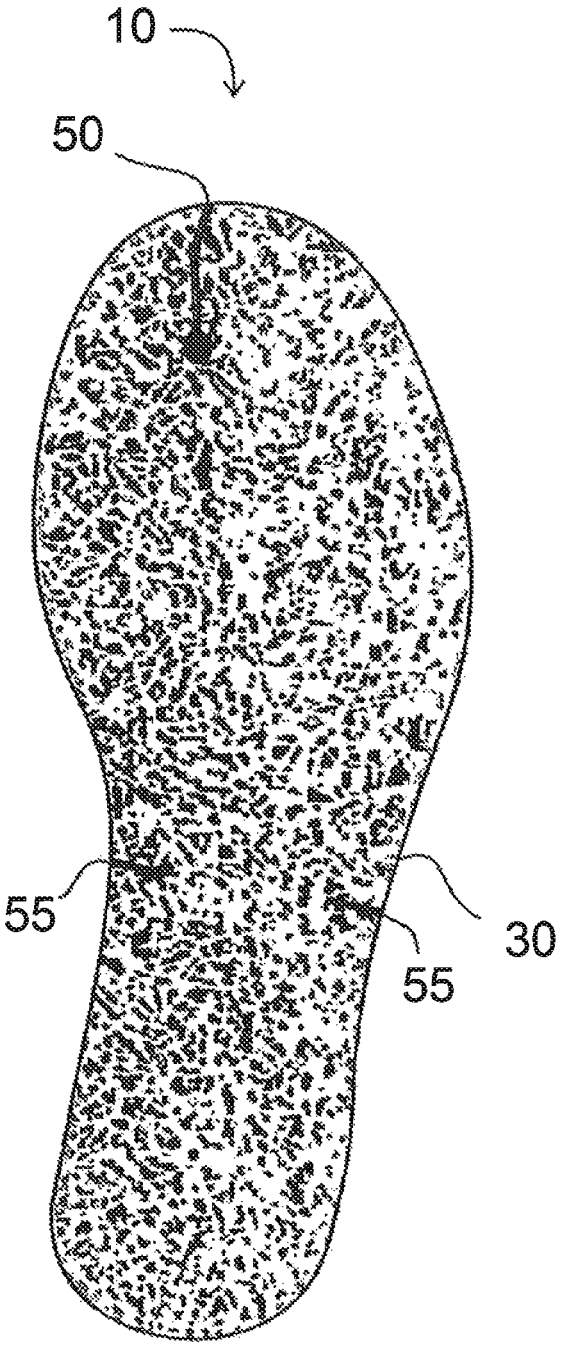
FIG. 9 is a top view of the bottom surface of the disposable insert for footwear showing an alternative embodiment having a front slit and a side slit.

Referring to FIGS. 8 and 9, an alternative embodiment of the current invention includes a front slit 50 and a side slit 55 for use with a pair of flip-flop 28 like shoes as depicted in FIG. 10.

Referring now to FIG. 10, an alternative embodiment of the invention allows a user or wearer to use the disposable insert 10 with flip-flop like shoes 28.

Figure 11:
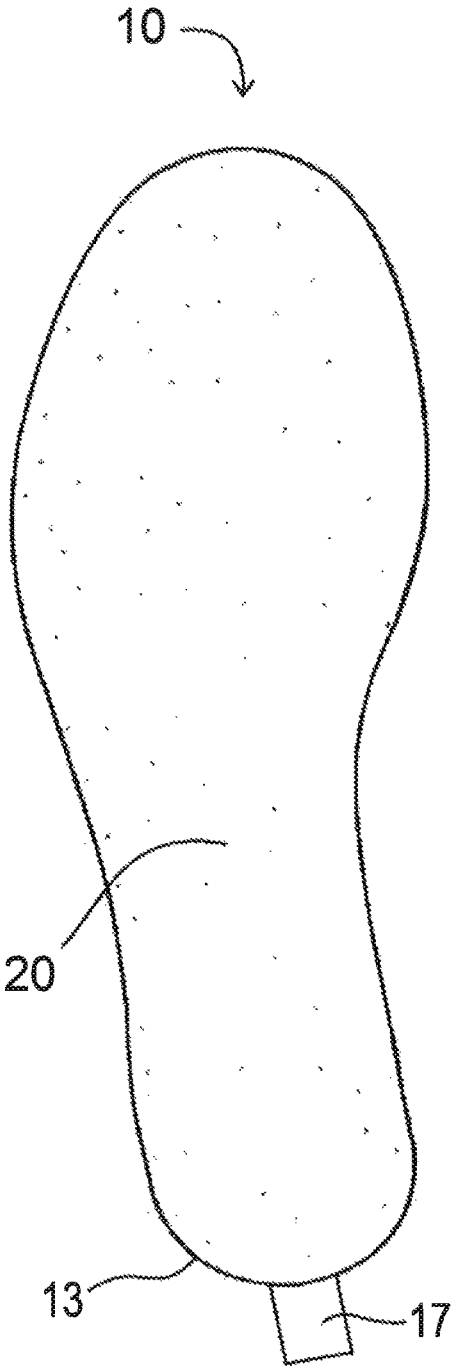
FIGS. 11 and 12 represent a top (See FIG. 11) and bottom (See FIG. 12) view respectively of the disposable insert having a tab on the back thereof for allowing a user to easily remove the insert from the wearer's shoe after use.
Figure 12:
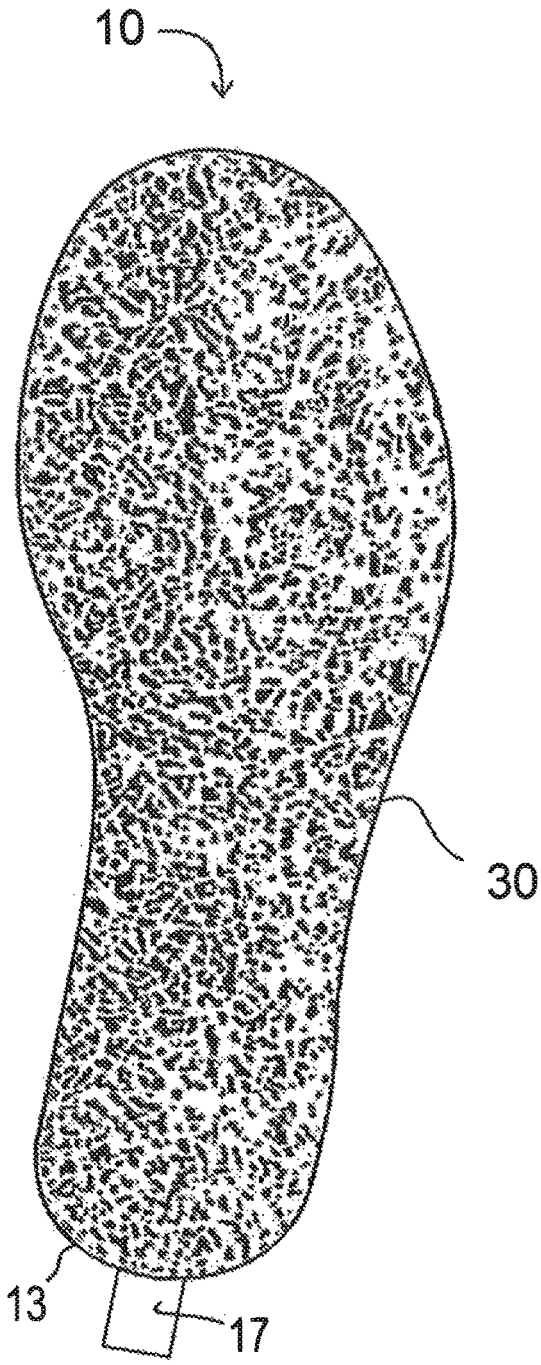

FIGS. 11 and 12 represent a top (See FIG. 11) and bottom (See FIG. 12) view respectively of the insert 10 having a tab 17 on the back portion 13 thereon for allowing the insert 10 to be removed easily from the wearer's shoe. Likewise, one embodiment of the invention includes tabs 17 on the back portion of the insert 10 which can be used on both walled shoes and unwalled shoes respectively.

Figure 13:
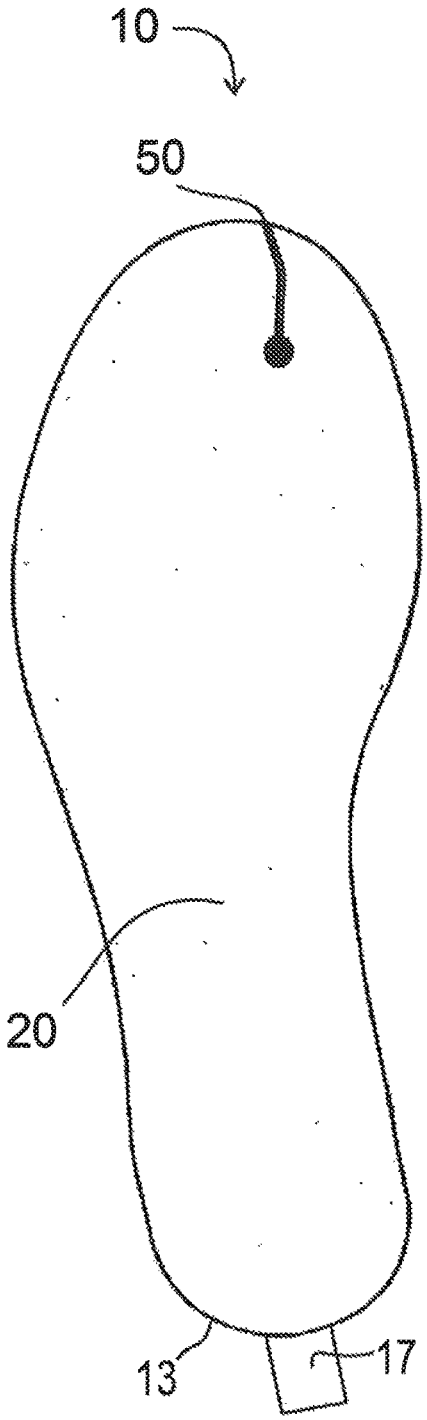
FIGS. 13 and 14 represent a top (See FIG. 13) and bottom (See FIG. 14) view respectively of the disposable insert having a tab on the back thereof and a front slit.
Figure 14:
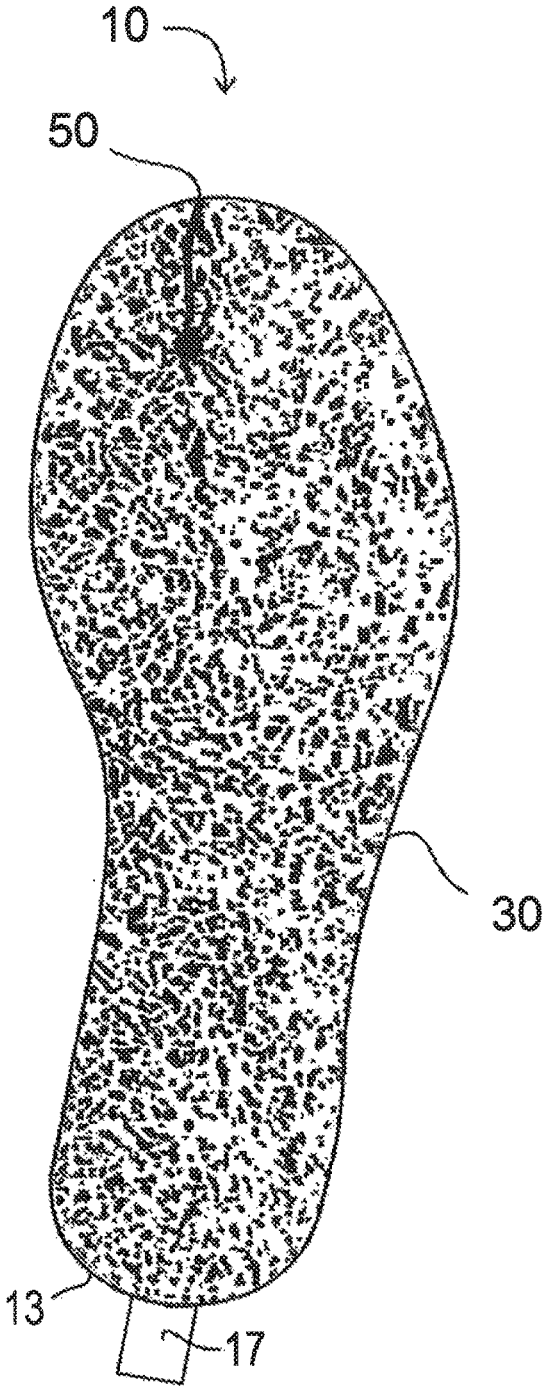

FIGS. 13 and 14 represent a top (See FIG. 13) and bottom (See FIG. 14) view of the disposable insert 10 having a tab 17 on the back thereof and also having a front slit 50. The tab 17 allows the insert 10 to be removed easily from the wearer's shoe after use.

Figure 15:
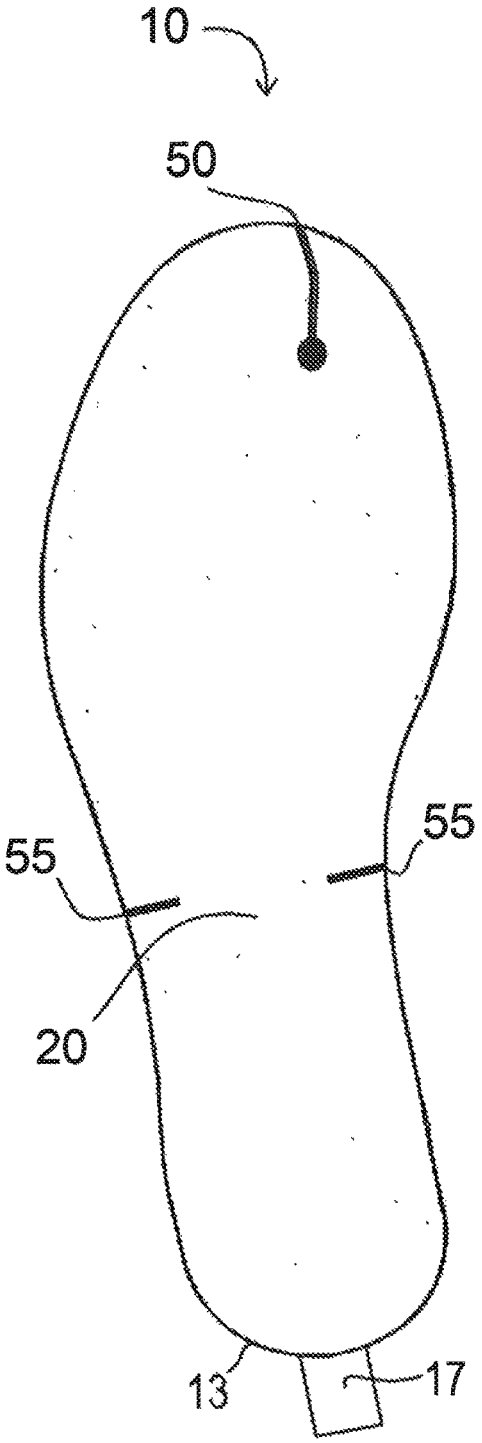
FIGS. 15 and 16 represent a top (See FIG. 15) and bottom (See FIG. 16) view respectively of the disposable insert having a tab on the back thereof and having a front and side slit respectively.
Figure 16:
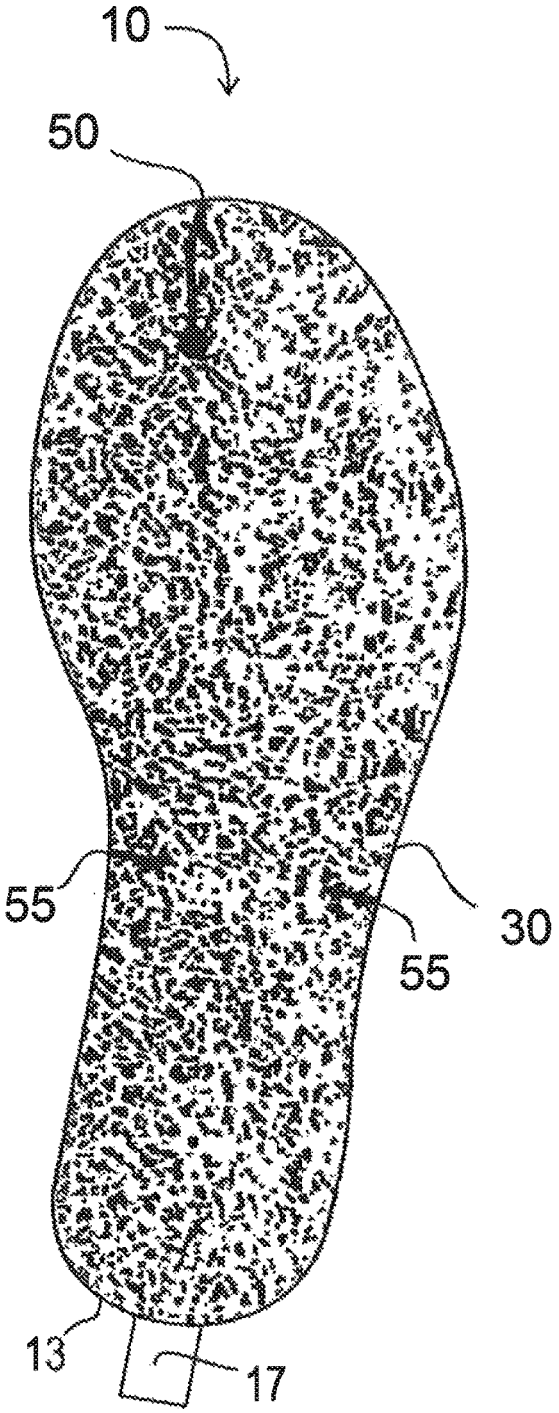

FIGS. 15 and 16 represent a top (See FIG. 15) and bottom (See FIG. 16) view respectively of the disposable insert 10 having a tab 17 on the back thereof and also having a front 50 and side 55 slits respectively.

It should be understood that the foregoing relates to various embodiments of the invention and that modifications may be made without departing from the spirit and scope of the invention. It should also be understood that the present invention is not limited to the designs mentioned in this application and the equivalent designs in this description, but it is also intended to cover other equivalents now known to those skilled in the art, or those equivalents which may become known to those skilled in the art in the future.

What is claimed is:

1. A disposable insert for footwear comprising:

a top surface and a bottom surface, wherein the surfaces are substantially thin and made of a polypropylene spunbonded nonwoven material (PP) to keep a wearer's foot clean by absorbing sweat, odor and dirt;

the top surface having a frictional surface for providing good traction to the bottom of the wearer's foot during use;

the bottom surface includes an anti-slip adhesive coating having a tack strength of 0.1 Lbf/in to 2.4 Lbf/in suitably configured to allow the insert to adequately grip an insole of a shoe to avoid slippage thereon during use; and the anti-slip adhesive coating further includes a peel adhesion strength of 0.1 Lbf/in to 2.0 Lbf/in suitably configured to allow the insert to be removed cleanly from the insole of the shoe without leaving a residue.

2. The disposable insert according to claim 1, wherein the PP spunbonded material is comprised of different colors to match the wearer's shoe for providing an aesthetically pleasing insert.

3. The disposable insert according to claim 1, wherein the PP spunbonded material is comprised of bright colors and patterns to provide an insert that will match the particular fashionable preference and/or style needs of the wearer.

4. The disposable insert according to claim 1, wherein said insert includes a tab on a back portion of the insert to allow the insert to be removed easily from the wearer's shoe after use.

* * * * *